US012442298B2

(12) United States Patent
Wang et al.

(10) Patent No.: US 12,442,298 B2
(45) Date of Patent: Oct. 14, 2025

(54) BOLTER MINER AND TUNNELING SYSTEM

(71) Applicants: CCTEG TAIYUAN RESEARCH INSTITUTE, Shanxi (CN); SHANXI TIANDI COAL MINING MACHINERY CO., LTD., Shanxi (CN)

(72) Inventors: Hong Wang, Shanxi (CN); Bukang Wang, Shanxi (CN); Dejun Song, Shanxi (CN); Kai Ma, Shanxi (CN); Jianwei Jia, Shanxi (CN); Yongcheng Ding, Shanxi (CN); Xiaofeng Zhang, Shanxi (CN); Faquan Li, Shanxi (CN); Qiang Ma, Shanxi (CN); Yanhua Qiao, Shanxi (CN); Ningning Wang, Shanxi (CN); Gehui Xie, Shanxi (CN); Feng Liu, Shanxi (CN); Sen Xu, Shanxi (CN); Qiang Zhang, Shanxi (CN); Qinghe Chen, Shanxi (CN); Hao Wang, Shanxi (CN); Dong Song, Shanxi (CN); Xuerui Zhang, Shanxi (CN); Weijian Qiu, Shanxi (CN); Mingjun Chen, Shanxi (CN); Xiaoli Ren, Shanxi (CN); Shengyuan Sang, Shanxi (CN); Jiquan Liu, Shanxi (CN); Xiaojing Peng, Shanxi (CN); Peng Li, Shanxi (CN); Jingong Ma, Shanxi (CN)

(73) Assignees: CCTEG TAIYUAN RESEARCH INSTITUTE, Shanxi (CN); SHANXI TIANDI COAL MINING MACHINERY CO., LTD., Shanxi (CN)

( * ) Notice: Subject to any disclaimer, the term of this patent is extended or adjusted under 35 U.S.C. 154(b) by 0 days.

(21) Appl. No.: 18/554,949

(22) PCT Filed: May 27, 2022

(86) PCT No.: PCT/CN2022/095785

§ 371 (c)(1),
(2) Date: Oct. 11, 2023

(87) PCT Pub. No.: WO2023/077784

PCT Pub. Date: May 11, 2023

(65) Prior Publication Data

US 2024/0200451 A1 Jun. 20, 2024

(30) Foreign Application Priority Data

Nov. 8, 2021 (CN) ..... 202111315963.7

(51) Int. Cl.
*E21B 44/00* (2006.01)
*E21B 7/02* (2006.01)
(Continued)

(52) U.S. Cl.
CPC ..... *E21D 20/003* (2013.01); *E21B 7/022* (2013.01); *E21B 19/083* (2013.01);
(Continued)

(58) Field of Classification Search
CPC ..... E21D 20/003; E21B 7/022; E21B 19/083; E21B 19/084; E21B 44/00; E21C 25/10; E21C 32/20; E21C 35/24; E21C 41/18
See application file for complete search history.

(56) References Cited

U.S. PATENT DOCUMENTS 5,087,102 A * 2/1992 Kiefer ..... E21C 27/20 299/33
5,334,838 A * 8/1994 Ramsden, Jr. ..... G01V 5/06 250/361 R
(Continued)

FOREIGN PATENT DOCUMENTS

CN 101922290 A 12/2010
CN 103993879 A 8/2014
(Continued)

OTHER PUBLICATIONS

Chen et al.; Machine translation CN 103993879; All; Aug. 2014 (Year: 2014).*
(Continued)

*Primary Examiner* — Benjamin F Fiorello
(74) *Attorney, Agent, or Firm* — Maginot, Moore & Beck, LLP

(57) ABSTRACT

A tunneling and anchoring machine (100) and a tunneling system, the tunneling and anchoring machine (100) comprising a rack (1), a cutting device (2), a drilling device (3) and a control device; the cutting device (2) has a lowest swing angle (B) and a highest swing angle (α); the drilling device (3) comprises a drilling machine (31) and a sensor, the sensor is electrically connected to the drilling machine (31), the drilling machine (31) is suitable for drilling a
(Continued)

roadway floor and/or a roadway roof, and the sensor is suitable for, when the drilling machine (31) is drilling, monitoring a set parameter of the drilling machine (31) and generating a monitoring data signal; the sensor is electrically connected to the control device, and the control device is suitable for receiving and analyzing the monitoring data signal; when the drilling machine (31) drills a first thickness of the roadway floor, if the monitoring data signal is greater than a first threshold, the control device is suitable for adjusting the lowest swing angle (β); and when the drilling machine (31) drills a second thickness of the roadway roof, if the monitoring data signal is greater than a second threshold, the control device is suitable for adjusting the highest swing angle (α).

19 Claims, 7 Drawing Sheets

(51) Int. Cl.

| | |
|---|---|
| ***E21B 19/083*** | (2006.01) |
| ***E21B 19/084*** | (2006.01) |
| ***E21C 25/10*** | (2006.01) |
| ***E21C 35/20*** | (2006.01) |
| ***E21C 35/24*** | (2006.01) |
| ***E21C 41/18*** | (2006.01) |
| ***E21D 20/00*** | (2006.01) |

(52) U.S. Cl.
CPC ..... *E21B 19/084* (2013.01); *E21B 44/00* (2013.01); *E21C 25/10* (2013.01); *E21C 35/20* (2013.01); *E21C 35/24* (2013.01); *E21C 41/18* (2013.01)

(56) References Cited

U.S. PATENT DOCUMENTS

| | | | | |
|---|---|---|---|---|
| 5,939,986 | A * | 8/1999 | Schiffbauer | B66C 15/045 340/541 |
| 6,296,317 | B1 * | 10/2001 | Ollis | E21C 35/302 701/28 |
| 6,666,521 | B1 * | 12/2003 | Pease | E21C 27/24 299/1.1 |
| 9,650,893 | B2 * | 5/2017 | Herdle | E21C 27/24 |
| 11,952,897 | B1 * | 4/2024 | Collins | E21D 9/108 |
| 2006/0087443 | A1 * | 4/2006 | Frederick | G08B 21/0213 340/573.4 |
| 2010/0221071 | A1 | 9/2010 | Hinshaw et al. | |
| 2012/0074759 | A1 * | 3/2012 | Weigel | E21C 35/04 299/1.6 |
| 2017/0114594 | A1 * | 4/2017 | Anttonen | E21B 6/00 |

FOREIGN PATENT DOCUMENTS

| | | | |
|---|---|---|---|
| CN | 205063841 | U | 3/2016 |
| CN | 112855203 | A1 | 5/2021 |
| CN | 114017022 | A | 2/2022 |
| JP | H4-83087 | A | 3/1992 |

OTHER PUBLICATIONS

International Search Report corresponding to PCT Application No. PCT/CN2022/095785, mailed Jul. 28, 2022 (Chinese and English language document) (6 pages).

* cited by examiner

BOLTER MINER AND TUNNELING SYSTEM

CROSS-REFERENCE TO RELATED APPLICATION

This application claims priority to and benefits of Chinese Patent Application No. 202111315963.7, filed on Nov. 8, 2021, the entire content of which is incorporated herein by reference.

FIELD

The present disclosure relates to the technical field of tunneling equipment, and more particularly to a bolter miner and a tunneling system using the bolter miner.

BACKGROUND

A bolter miner is mining equipment that can achieve tunneling and bolt support. The bolter miner is equipped with a cutting device and a bolt support device, in which the cutting device is used for tunneling operations, and the bolt support device is used for bolt support operations. The cutting device includes a cutting drum used to cut coal walls and a cutting arm used to drive the cutting drum to swing up and down.

In order to ensure the mining efficiency and smooth tunneling footage, the bolter miner needs to advance along an extension direction of a coal seam. However, in the related art, due to the uncertainty of a dip angle of the front coal seam and the unevenness of the coal seam, the bolter miner may cut the roof and floor during the advancing process. As a result, the recovery rate is lowered, and the tunneling equipment is prone to damage due to the big hardness of rocks, causing production delay.

SUMMARY

The present disclosure aims solve at least one of the problems existing in the related art to at least some extent.

To this end, embodiments of the present disclosure propose a bolter miner that prevents the cutting device from cutting a roof rock stratum and a floor rock stratum, improves the recovery rate, and prolongs the equipment service life.

Embodiments of the present disclosure also propose a tunneling system using the above bolter miner.

A bolter miner according to embodiments of the present disclosure includes: a rack; a cutting device arranged on the rack and being swingable in an up-down direction, wherein the cutting device includes a lowest swing angle, at which the cutting device is configured to cut coal rock at a bottom of a working face, and includes a highest swing angle, at which the cutting device is configured to cut coal rock at a top of the working face; a drilling device arranged on the rack and including a drilling rig and a sensor electrically connected to the drilling rig, wherein the drilling rig is configured to drill a tunnel floor and/or a tunnel roof, and the sensor is configured to monitor set parameters of the drilling rig and generate a monitoring data signal when the drilling rig is drilling; and a control device, to which the sensor is electrically connected, wherein the control device is configured to receive and analyze the monitoring data signal; when the drilling rig is drilling the tunnel floor by a first thickness, the control device is configured to reduce the lowest swing angle in response to the monitoring data signal being greater than a first threshold; and when the drilling rig is drilling the tunnel roof by a second thickness, the control device is configured to reduce the highest swing angle in response to the monitoring data signal being greater than a second threshold.

The bolter miner according to embodiments of the present disclosure prevents the cutting device from cutting the roof rock stratum and the floor rock stratum, improves the recovery rate, and prolongs the equipment service life.

In some embodiments, the drilling device includes a lifting assembly connected to the rack; the drilling rig is arranged on the lifting assembly and is configured to install anchor rods; the lifting assembly is configured to lift the drilling rig, to allow the drilling rig to drill the tunnel floor and the tunnel roof.

In some embodiments, the drilling device includes a connecting member and a swinging driver; the connecting member has a first end connected to the lifting assembly and a second end rotatably connected to the rack; the swinging driver has a first end rotatably connected to the rack and a second end rotatably connected to the connecting member; the swinging driver is configured to drive the connecting member to swing in a width direction of the rack to adjust a distance between the drilling rig and a tunnel lateral wall.

In some embodiments, the drilling device includes a displacement driver, an extension direction of the displacement driver being identical to an extension direction of the connecting member; the displacement driver has a first end rotatably connected to the rack and a second end rotatably connected to the lifting assembly; the connecting member and the displacement driver are configured to expand and retract synchronously; the displacement driver is configured to drive the drilling rig to move in a length direction of the rack to adjust row spacing of anchor rods.

In some embodiments, the connecting member includes an inner sleeve and an outer sleeve; the inner sleeve is fitted in the outer sleeve and is slidable relative to the outer sleeve; a free end of the outer sleeve is rotatably connected to the rack, and a free end of the inner sleeve is rotatably connected to the lifting assembly; the swinging driver is rotatably connected to the outer sleeve; the outer sleeve is provided with an oil injection mouth configured to inject lubricating oil into the outer sleeve.

In some embodiments, the drilling rig is rotatably connected to the lifting assembly, and the drilling rig is swingable in a height direction of the rack and the length direction of the rack to adjust an anchor rod installation direction.

In some embodiments, the lifting assembly includes a frame body, a lifting driver, a guide column, a mounting plate and a chain; the guide column is arranged on the frame body and extends in the up-down direction; the mounting plate is mounted on the guide column in a guided and sliding manner and is configured to mount the drilling rig; one end of the lifting driver is connected to the frame body, and the lifting driver is provided with a first gear and a second gear, which are spaced apart along an extension direction of the lifting driver; the chain is engaged around outer circumferences of the first gear and the second gear and is connected to the mounting plate and the frame body, and the chain is configured to translate and rotate to drive the mounting plate to move, when the lifting driver is extended and retracted.

In some embodiments, the drilling device install anchor rods and includes a first drilling device and a second drilling device; the first drilling device and the second drilling device are arranged at a tail end of the rack and spaced apart along the width direction of the rack; the first drilling device is configured to drill and install anchor rods to a first lateral wall of the tunnel; and the second drilling device is configured to drill and install anchor rods to a second lateral wall of the tunnel.

In some embodiments, the bolter miner further includes a shovel plate device and a conveying trough device. The shovel plate device is arranged at a head end of the rack and below the cutting device; a size of an inlet of the shovel plate device is adjustable; and the conveying trough device is arranged on the rack and at a rear side of the shovel plate device and is configured to convey coal rock gathered by the shovel plate device.

In some embodiments, the first drilling device is arranged at a first side of the conveying trough device, and the second drilling device is arranged at a second side of the conveying trough device.

In some embodiments, the first threshold is identical to the second threshold when lithology of the tunnel roof is consistent with lithology of the tunnel floor.

In some embodiments, the bolter miner further includes a bolt support device that includes a lifting assembly, a work platform and a first drilling frame assembly. The lifting assembly is arranged between the rack and the work platform and is configured to raise and lower the work platform; the first drilling frame assembly is arranged on the work platform; the work platform is telescopic to allow the first drilling frame assembly to move to above the cutting device; the first drilling frame assembly is configured for bolt support for the roof above the cutting device to reduce an unsupported roof distance.

In some embodiments, the bolt support device includes a stabilization assembly that includes a first support assembly and a second support assembly; the first support assembly and the second support assembly are arranged on the work platform; the first support assembly extends upward and is configured to support the tunnel roof; and the second support assembly extends downward and is configured to support the cutting device.

In some embodiments, the bolt support device includes a second drilling frame assembly arranged on the work platform; the drilling device installs anchor rods; the second drilling frame assembly is arranged between the first drilling frame assembly and the drilling device and cooperates with the drilling device to provide bolt support for a tunnel lateral wall.

In some embodiments, the bolter miner further includes a propping device that includes a first propping device and a second propping device. The first propping device is arranged at a first side of the rack and propped between a first lateral wall of the tunnel and the rack, and the second propping device is arranged at a second side of the rack and propped between a second lateral wall of the tunnel and the rack.

In some embodiments, a drilling operation on the tunnel floor includes: S1: determining the number of cycles of tunneling footage advanced by the cutting device according to a thickness of a coal seam; S2: determining a drilling position on the tunnel floor after the cutting device advances a determined number of cycles of tunneling footage; S3: driving the rack to move, moving the drilling device to a position corresponding to the drilling position on the tunnel floor, and drilling the tunnel floor by the drilling device; S4: transmitting a monitoring data signal to the control device in real time by using the sensor in a process of drilling the tunnel floor by a first thickness through the drilling device; and S5: analyzing and comparing, by the control device, the monitoring data signal with the first threshold in real time, and correcting the lowest swing angle of the cutting device inside the control device in response to the monitoring data signal being greater than the first threshold.

In some embodiments, a drilling operation on the tunnel roof includes: S1: determining the number of cycles of tunneling footage advanced by the cutting device according to a thickness of a coal seam; S2: determining a drilling position on the tunnel roof after the cutting device advances a determined number of cycles of tunneling footage; S3: driving the rack to move, moving the drilling device to a position corresponding to the drilling position on the tunnel roof, and drilling the tunnel roof by the drilling device; S4: transmitting a monitoring data signal to the control device in real time by using the sensor in a process of drilling the tunnel roof by a second thickness through the drilling device; and S5: analyzing and comparing, by the control device, the monitoring data signal with the second threshold in real time, and correcting the lowest swing angle of the cutting device inside the control device in response to the monitoring data signal being greater than the second threshold.

A tunneling system according to embodiments of the present disclosure includes the bolter miner according to any one of the above embodiments.

Figure 1:
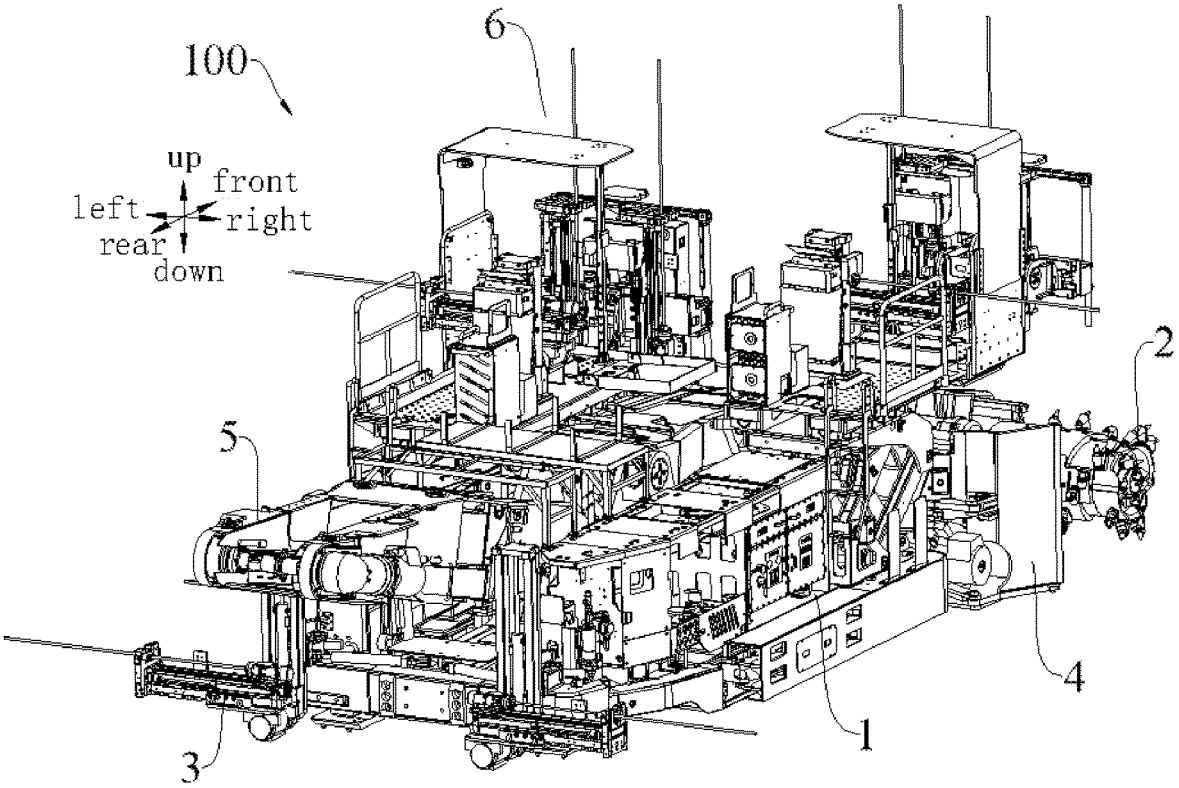
FIG. 1 is a rear perspective view of a bolter miner according to embodiments of the present disclosure.

REFERENCE NUMERALS bolter miner 100;
rack 1;
cutting device 2; cutting drum 21;
drilling device 3; first drilling device 301; second drilling device 302;
drilling rig 31;
lifting assembly 32; frame body 321; chain connecting portion 3211; lifting driver 322;
first gear 3221; second gear 3222; guide column 323; mounting plate 324; chain 325;

connecting member 33; outer sleeve 331; inner sleeve 332;
swinging driver 34;
displacement driver 35;
shovel plate device 4;
conveying trough device 5;
bolt support device 6; first bolt support device 601; second bolt support device 602;
lifting component 61;
work platform 62;
first drilling frame assembly 63; mounting seat 631; first anchor drill 632; second anchor drill 633;
stabilization assembly 64; first support assembly 641; second support assembly 642;
second drilling frame assembly 65.

DETAILED DESCRIPTION

Embodiments of the present disclosure will be described in detail below, and examples of the embodiments will be shown in the accompanying drawings. The embodiments described below are exemplary and are intended to explain the present disclosure rather than limit the present disclosure.

As shown in FIGS. 1 to 14, a bolter miner 100 according to embodiments of the present disclosure includes a rack 1, a cutting device 2, a drilling device 3 and a control device (not shown).

Figure 3:
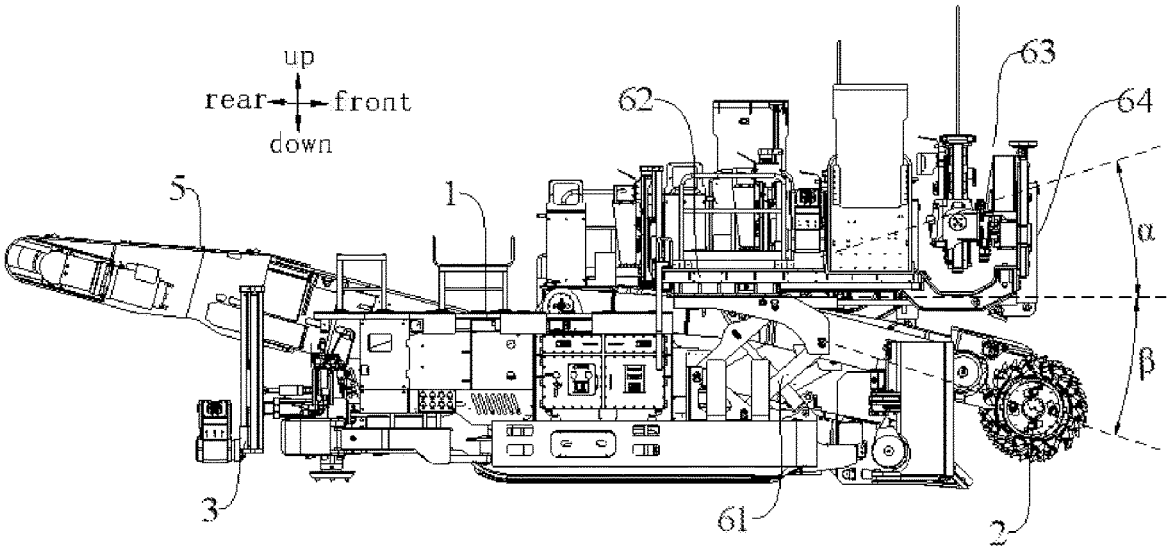
FIG. 3 is a right view of the bolter miner according to embodiments of the present disclosure.

The rack 1 is a body frame of the bolter miner 100 and can be formed by welding profiles. As shown in FIG. 3, the rack 1 is arranged to extend in a front-rear direction.

The cutting device 2 is arranged on the rack 1 and is swingable in an up-down direction. The cutting device 2 includes a lowest swing angle and a highest swing angle. At the lowest swing angle, the cutting device 2 is configured to cut coal rock at the bottom of a working face, and at the highest swing angle, the cutting device 2 is configured to cut coal rock at the top of the working face.

Figure 2:
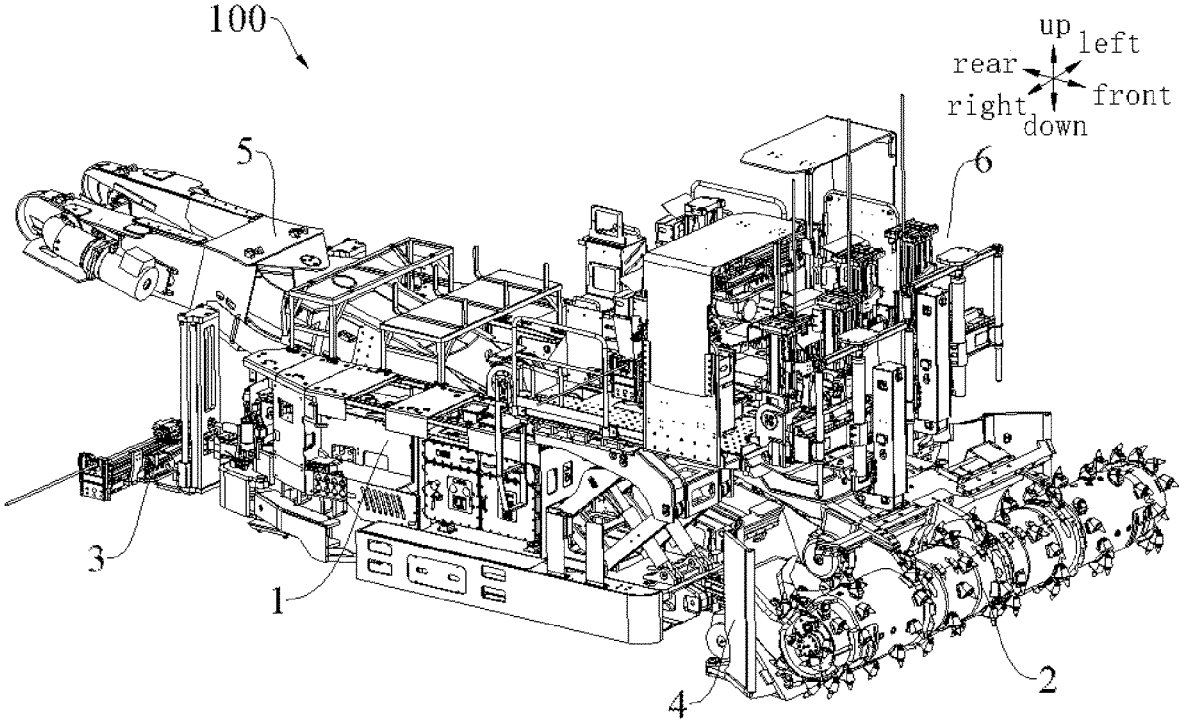
FIG. 2 is a front perspective view of the bolter miner according to embodiments of the present disclosure.

Specifically, as shown in FIGS. 2 and 3, the cutting device 2 is arranged on a front side of the rack 1. The cutting device 2 includes a cutting arm and a cutting drum 21. The cutting arm generally extends in the front-rear direction, and a rear end of the cutting arm is connected to the rack 1 and is swingable in the up-down direction relative to the rack 1. For example, the rear end of the cutting arm is rotatably connected to the rack 1 through a pivot shaft. The cutting drum 21 is assembled at a front end of the cutting arm, and the cutting drum 21 is provided with cutting teeth and can rotate by itself. When in use, the cutting arm swings up and down to drive the cutting drum 21 to move up and down, and the rotating cutting drum 21 will cut a coal wall, realizing a cutting operation on the front coal wall.

As shown in FIG. 3, the cutting arm has the highest swing angle $\alpha$ and the lowest swing angle $\beta$ during an up-and-down swing stroke of the cutting arm. The highest swing angle $\alpha$ is a maximum upward swing angle of the cutting arm during actual use, that is, an included angle between an axial direction of the cutting arm and a horizontal direction after the cutting arm swings upward. The lowest swing angle $\beta$ is a maximum downward swing angle of the cutting arm during actual use, that is, the included angle between the axial direction of the cutting arm and the horizontal direction after the cutting arm swings downward.

It should be noted that when the cutting arm swings to the highest swing angle $\alpha$, the cutting drum 21 can cut a top of a heading working face; and when the cutting arm swings to the lowest swing angle $\beta$, the cutting drum 21 can cut a bottom of the heading working face. By swinging the cutting arm within a range formed by the highest swing angle $\alpha$ and the lowest swing angle $\beta$, the cutting operation on the coal wall of the heading working face can be completed.

The drilling device 3 is arranged on the rack 1 and includes a drilling rig 31 and a sensor electrically connected to the drilling rig 31. The drilling rig 31 is configured to drill a tunnel floor and/or a tunnel roof. The sensor is configured to monitor set parameters of the drilling rig 31 and generate a monitoring data signal when the drilling rig 31 is drilling.

Specifically, the drilling rig 31 may be a roof bolter 31 and can perform drilling operations such as hole drilling and rock sampling. The set parameters of the drilling rig 31 may include a propulsion force of the drilling rig 31, and in this case, the sensor may be a pressure sensor. When the drilling rig 31 drills holes on the tunnel floor or tunnel roof, the sensor can monitor a reverse force exerted by a formation on the drilling rig 31. The reverse force and the propulsion force required by the drilling rig 31 can be regarded as interaction forces, so that the propulsion force of the drilling rig 31 can be monitored.

Since different strata have different lithology, the drilling rig 31 needs to exert different propulsion forces during drilling operations. For example, the drilling rig 31 needs to exert a relatively small propulsion force when drilling a coal seam due to its soft texture; and the drilling rig 31 needs to exert a relatively large propulsion force when drilling a rock stratum due to its hard texture. By monitoring different propulsion forces, it can be judged whether the drilling rig 31 is drilling a rock stratum or a coal seam.

It can be understood that in other embodiments, the set parameters of the drilling rig 31 can also be parameters that can reflect properties of the formation, such as working power and hydraulic system pressure of the drilling rig 31. In this case, the sensor is one that can monitor the corresponding parameters.

The sensor is electrically connected to the control device, and the control device is configured to receive and analyze the monitoring data signal. When the drilling rig 31 is drilling the tunnel floor by a first thickness, the control device is configured to reduce the lowest swing angle if the monitoring data signal is greater than a first threshold. When the drilling rig 31 is drilling the tunnel roof by a second thickness, the control device is configured to reduce the highest swing angle if the monitoring data signal is greater than a second threshold.

Specifically, the control device is a PLC control system, but it can also be other types of controllers or processors. The sensor is electrically connected to the control device through wires. In other embodiments, the sensor can also transmit data signals to the control device through wireless transmission. The control device is fixed on an inner side of the rack 1, to provide a protective effect.

The monitoring data signal monitored by the sensor is transmitted to the control device, and the control device converts the received monitoring data signal into a numerical parameter, which is compared with the preset first threshold or second threshold. Finally, the swing of the cutting arm is controlled based on a comparison result. The first threshold is a numerical parameter corresponding to a propulsion force when breaking through an interface between a coal seam and a rock stratum below the coal seam, and the second threshold is a numerical parameter corresponding to a propulsion force when breaking through an interface between the coal seam and a rock stratum above the coal seam.

It should be noted that the first thickness is a floor thickness drilled by the drilling rig 31 when drilling the tunnel floor, and the second thickness is a roof thickness drilled by the drilling rig 31 when drilling the tunnel roof. The first thickness and the second thickness need to be selected according to requirements and experience. For example, the first thickness is a remaining coal seam thickness allowed by the floor, and the second thickness is a remaining coal seam thickness allowed by the roof.

For example, when the drilling rig 31 is drilling the tunnel floor by the first thickness, the control device can receive the monitoring data signal in real time, and after receiving the monitoring data signal, the control device compares the monitoring data signal with the first threshold. If the numerical parameter corresponding to the monitoring data signal is greater than the first threshold, it can be determined that the cutting device 2 has cut to or near the rock stratum below the coal seam. By reducing the lowest swing angle ß of the cutting arm through the control device, the cutting drum 21 of the cutting device 2 can be prevented from continuing cutting the rock stratum below.

In a process of drilling the tunnel roof by the drilling rig 31, the control device can receive the monitoring data signal in real time and compare the monitoring data signal with the second threshold after receiving the monitoring data signal. If the numerical parameter corresponding to the monitoring data signal is greater than the second threshold, it can be determined that the cutting device 2 has cut to or near the rock above the coal seam. By reducing the highest swing angle $\alpha$ of the cutting arm through the control device, the cutting drum 21 of the cutting device 2 can be prevented from continuing cutting the rock stratum above.

It should be noted that with the advancement of the bolter miner 100, the drilling operation can be carried out at each cycle of tunneling footage or at intervals of a set number of cycles of tunneling footage. The timing for the drilling operation can be selected as required.

It can be understood that a monitor for identifying whether the drilling device 3 is drilling the tunnel roof or the tunnel floor can be added in the present disclosure. The monitor may be a position monitor, such as an infrared monitor, which can monitor a position change of the drilling device 3, to provide a basis for the control device to judge whether the tunnel roof or the tunnel floor is being drilled.

In the bolter miner 100 according to embodiments of the present disclosure, since a cutting direction of the cutting device 2 can be corrected in time by the drilling device 3 and the control device, the cutting device 2 can be prevented from cutting roof and floor rock strata, allowing the cutting device 2 to always perform cutting operations on the coal seam.

Moreover, since the situation of cutting roof and floor rock strata is avoided, a situation that a large deviation of the cutting direction causes a large amount of coal resources left in roof coal seam or floor coal seams opposite to the deviation direction is avoided, and the recovery rate is thus improved.

In addition, since the bolter miner 100 works in the coal seam, it is possible to prevent the bolter miner 100 from cutting the hard rock stratum and from being easily damaged because of cutting the rock stratum. Consequently, a smooth progress of the tunneling operation is ensured, the equipment service life is prolonged, the amount of mined gangue is reduced, and the environmental-friendly and efficient mining of the coal seams is realized.

In some embodiments, the drilling device 3 includes a lifting assembly 32 connected to the rack 1. The drilling rig 31 is arranged on the lifting assembly 32 and is configured to install anchor rods. The lifting assembly 32 is configured to lift the drilling rig 31, to allow the drilling rig 31 to drill the tunnel floor and the tunnel roof.

Figure 6:
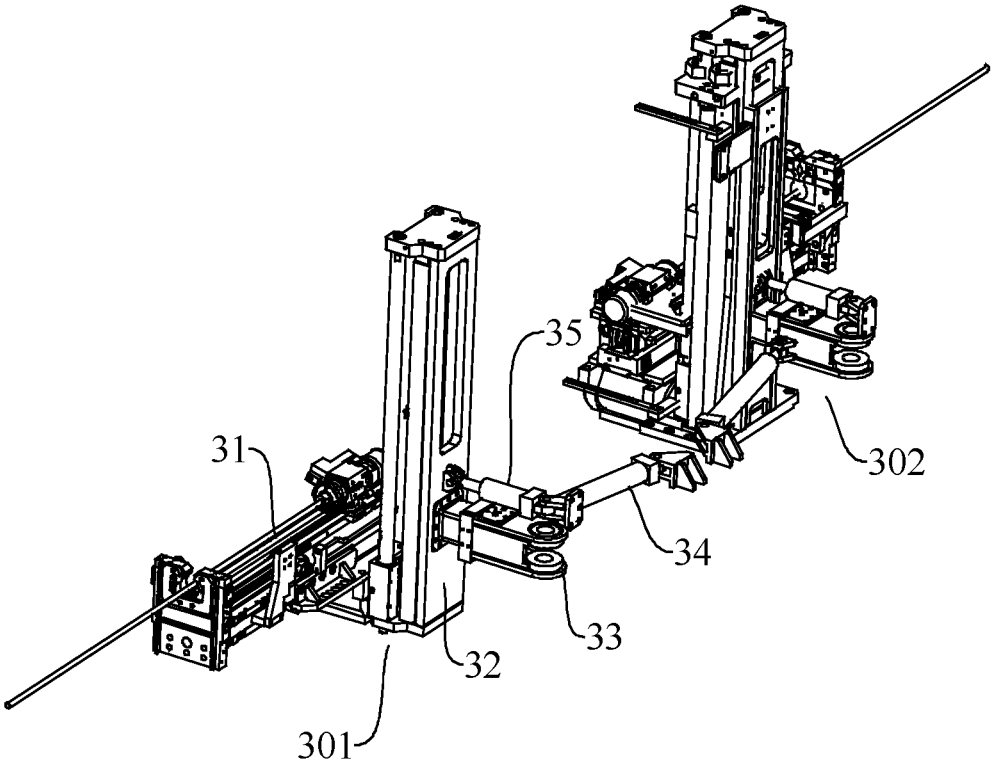
FIG. 6 is a schematic view of a front structure of the drilling device in FIG. 5.

Specifically, as shown in FIG. 6, the lifting assembly 32 is detachably mounted on the rack 1 through fasteners such as bolts and nuts, and includes a hydraulic telescopic cylinder, which can extend along the up-down direction. The drilling rig 31 is connected to the hydraulic telescopic cylinder, and the drilling rig 31 can move up and down through expansion and retraction of the hydraulic telescopic cylinder. Therefore, the drilling rig 31 can perform drilling operations on both the tunnel floor and the tunnel roof, which makes the use of the drilling rig 31 more flexible.

It can be understood that, in some other embodiments, the lifting assembly 32 can also be other lifting assemblies 32, such as a scissor-type lifting device and a lead screw drive device.

In some embodiments, the drilling device 3 includes a connecting member 33 and a swinging driver 34. The connecting member 33 has a first end connected to the lifting assembly 32 and a second end rotatably connected to the rack 1. The swinging driver 34 has a first end rotatably connected to the rack 1 and a second end rotatably connected to the connecting member 33. The swinging driver 34 is configured to drive the connecting member 33 to swing in a width direction of the rack 1 to adjust a distance between the drilling rig 31 and a tunnel lateral wall.

Specifically, as shown in FIGS. 6 to 9, the drilling device 3 is arranged at a rear end of the rack 1, and the connecting member 33 is a connecting rod. The connecting member 33 has a first end connected and fixed to the rear end of the rack 1 by fasteners such as bolts, and a second end pivotally connected to the lifting assembly 32 with a pivot shaft extending in the up-down direction. Consequently, the connecting member 33 can only swing in a left-right direction.

The swinging driver 34 is a hydraulic telescopic cylinder, and has a first end hinged with the rack 1 and a second end hinged with the connecting member 33. In such a way, the swing drive of the connecting member 33 can be realized through expansion and retraction of the swinging telescopic device, and then the swing drive of the lifting assembly 32 and the drilling rig 31 in the left-right direction can be achieved, thereby facilitating the adjustment of the distance between the drilling rig 31 and the tunnel lateral wall.

In some embodiments, the drilling device 3 includes a displacement driver 35, an extension direction of the displacement driver 35 is the same as an extension direction of the connecting member 33. The displacement driver 35 has a first end rotatably connected to the rack 1 and a second end rotatably connected to the lifting assembly 32. The connecting member 33 and the displacement driver 35 can expand and retract synchronously. The displacement driver 35 is configured to drive the drilling rig 31 to move in a length direction of the rack 1 to adjust row spacing of anchor rods.

Specifically, as shown in FIGS. 6 to 9, the displacement driver 35 is a hydraulic telescopic oil cylinder; a rear end of the displacement driver 35 is hinged or pivotally assembled with the lifting assembly 32, and a front end of the displacement driver 35 is hinged or pivotally assembled with the rack 1. The displacement driver 35 and the connecting member 33 are arranged generally in parallel, and the connecting member 33 is telescopic; for example, the connecting member 33 is a telescopic rod. Both ends of the displacement driver 35 are hinged, so that the displacement driver 35 can swing, meeting swing requirements of the swinging driver 34.

Therefore, the lifting assembly 32 and the drilling rig 31 can move forward and backward through the expansion and retraction of the displacement driver 35, so that the drilling rig 31 can meet the requirements of anchor rod installation with different row spacing and is convenient to use.

It should be noted that the connecting member 33 can form a triangular structure with the rack 1 and the swinging driver 34, facilitating the swing drive of the drilling rig 31, and the connecting member 33 can withstand shear force during operation of the drilling rig 31 and protect the displacement driver 35.

In some embodiments, the connecting member 33 includes an inner sleeve 332 and an outer sleeve 331. The inner sleeve 332 is fitted in the outer sleeve 331 and is slidable relative to the outer sleeve 331. A free end of the outer sleeve 331 is rotatably connected to the rack 1, and a free end of the inner sleeve 332 is rotatably connected to the lifting assembly 32. The swinging driver 34 is rotatably connected to the outer sleeve 331. The outer sleeve 331 is provided with an oil injection mouth configured to inject lubricating oil into the outer sleeve 331.

Figure 11:
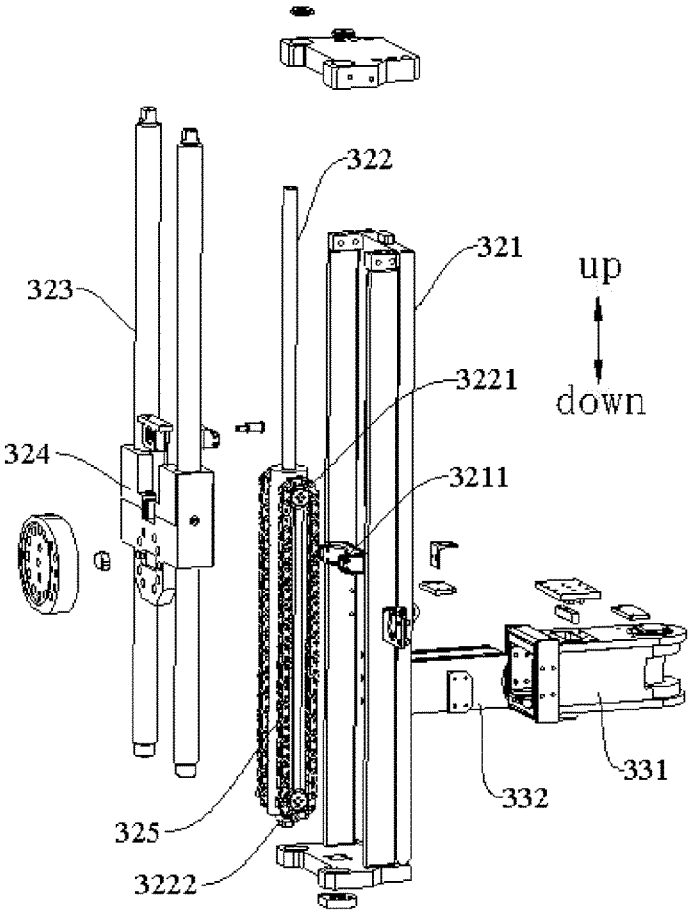
FIG. 11 is an exploded view of the lifting assembly in FIG. 10.

Specifically, as shown in FIG. 11, the inner sleeve 332 and the outer sleeve 331 are both square sleeves, and the square design of the inner sleeve 332 and the outer sleeve 331 has an anti-rotation effect, so that the inner sleeve 332 can only move along an axial direction of the connecting member 33. A rear end of the outer sleeve 331 is pivotally connected to the rack 1, and the inner sleeve 332 is slidably guided and assembled at a front end of the outer sleeve 331, and a front end of the inner sleeve 332 is connected and fixed to the lifting assembly 32. The oil injection mouth is on a top surface of the outer sleeve 331 and is convenient to use. The lubricating oil can be injected into the outer sleeve 331 through the oil injection mouth, so that the inner sleeve 332 and the outer sleeve 331 can slide more smoothly.

Optionally, the oil injection mouth is provided with a protective structure, avoiding damage to the oil injection mouth during bolt support operations.

In some embodiments, the drilling rig 31 is rotatably connected to the lifting assembly 32, and the drilling rig 31 is swingable in a height direction of the rack 1 and the length direction of the rack 1 to adjust anchor rod installation directions.

Figure 7:
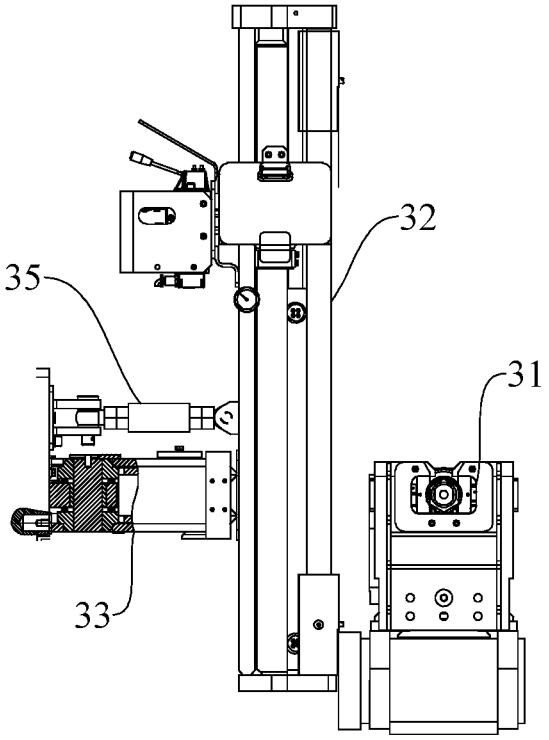
FIG. 7 is a side view of a single drilling device in FIG. 5.
Figure 8:
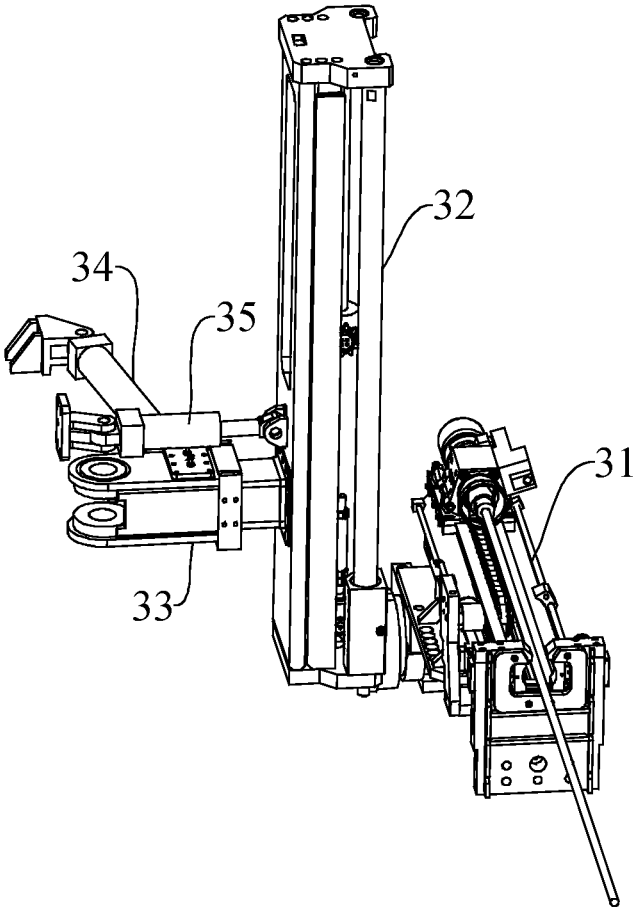
FIG. 8 is a first perspective view of the single drilling device in FIG. 5.
Figure 9:
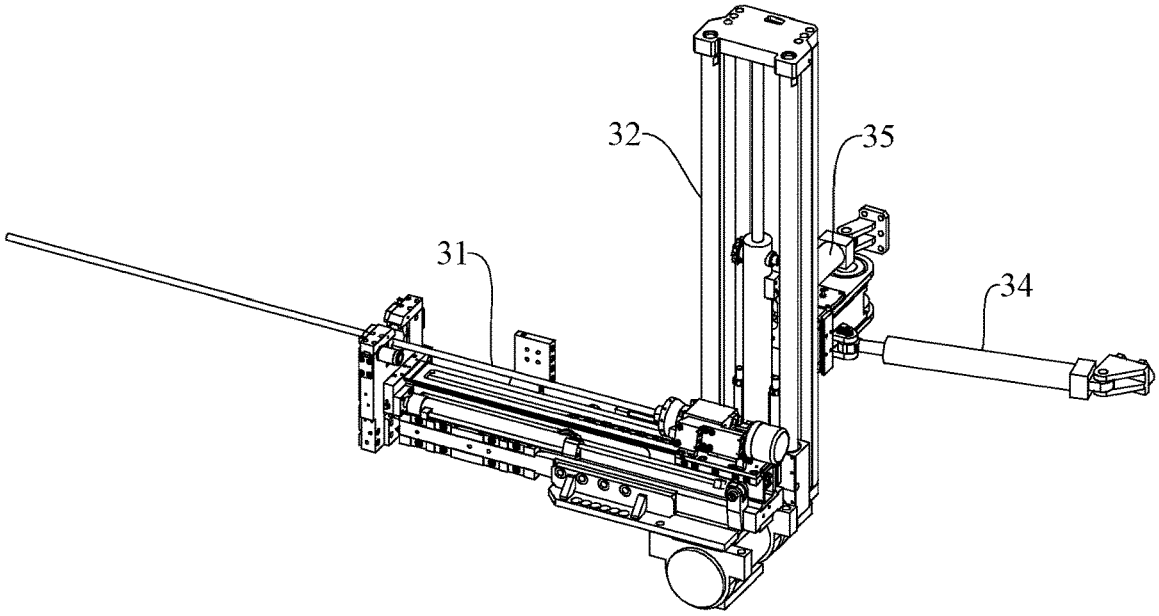
FIG. 9 is a second perspective view of the single drilling device in FIG. 5.

Specifically, as shown in FIGS. 7 and 8, the drilling rig 31 is connected to the lifting assembly 32 through a rotary drive, and the rotary drive has two rotation axes. An extension direction of one rotation axis is the same as the extension direction of the connecting member 33, and the drilling rig 31 is rotatable around this rotation axis and hence can swing in the up-down direction (the height direction of the rack 1). The other rotation axis extends in the up-down direction, and the drilling rig 31 is rotatable around this rotation axis and hence can swing in the front-rear direction (the length direction of the rack 1).

Since the drilling rig 31 can swing and be adjusted in both the height direction and the length direction of the rack 1, and the drilling rig 31 can adjust its position in the up-down direction through the lifting assembly 32, the drilling rig 31 has a high degree of adjustment freedom in space, meeting the requirement of anchor rod installation in any direction.

It should be noted that since the drive of the swinging driver 34 is accompanied by a change in an azimuth angle of the drilling rig 31, the drilling rig 31 can swing in the length direction of the rack 1 and thus the drilling rig 31 can be re-adjusted to a position perpendicular to the tunnel lateral wall, facilitating the anchor rod installation.

In some embodiments, the lifting assembly 32 includes a frame body 321, a lifting driver 322, a guide column 323, a mounting plate 324 and a chain 325. The guide column 323 is arranged on the frame body 321 and extends in the up-down direction. The mounting plate 324 is mounted on the guide column 323 in a guided and sliding manner and is configured to mount the drilling rig 31. One end of the lifting driver 322 is connected to the frame body 321. The lifting driver 322 is provided with a first gear 3221 and a second gear 3222, which are spaced apart along an extension direction of the lifting driver 322. The chain 325 is engaged around outer circumferences of the first gear 3221 and the second gear 3222 and is connected to the mounting plate 324 and the frame body 321. The chain 325 is configured to translate and rotate to drive the mounting plate 324 to move, when the lifting driver 322 is extended and retracted.

Figure 10:
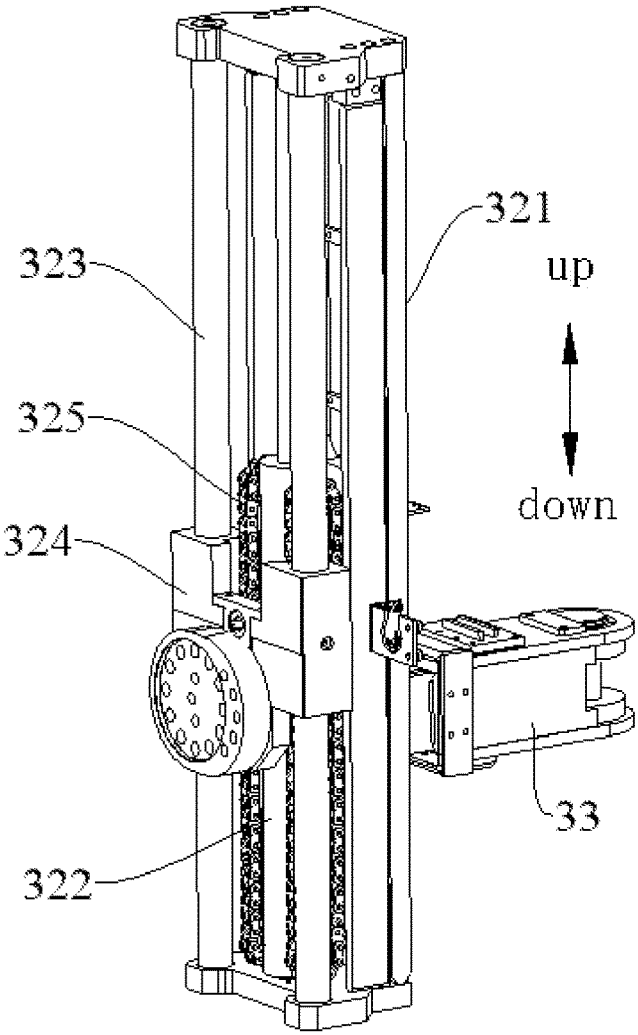
FIG. 10 is a schematic view of a lifting assembly of the drilling device in FIG. 9.

Specifically, as shown in FIG. 10 and FIG. 11, the frame body 321 may be generally rectangular, and the frame body 321 extends in the up-down direction. The lifting driver 322 may be a hydraulic telescopic oil cylinder, and has a top end fixedly connected to a top end of the frame body 321 and a bottom end being a free end. The lifting driver 322 extends in the up-down direction and is telescopic in the up-down direction. The lifting driver 322 includes a piston rod and a cylinder body, the piston rod may be fixedly connected to the top end of the frame body 321, and a bottom end of the cylinder body is a free end.

Two guide columns 323 can be provided, both of which may be fixed to the frame body 321. The two guide columns 323 extend in the up-down direction and are spaced apart in the left-right direction. The mounting plate 324 is assembled on the two guide columns 323 in a guided manner and is slidable in the up-down direction. The drilling rig 31 can be connected to the mounting plate 324 through the rotary drive.

The first gear 3221 and the second gear 3222 are arranged on an outer side of the cylinder body of the lifting driver 322 and are spaced apart in the up-down direction, both of which are rotatable relative to the cylinder body. The chain 325 surround the outer circumferences of the first gear 3221 and the second gear 3222 and is engaged with both the first gear 3221 and the second gear 3222. A rear side of the chain 325 can be connected to the frame body 321, and a front side of the chain 325 can be connected to the mounting plate 324.

Consequently, when the cylinder body of the lifting driver 322 moves up and down, the chain 325 undergoes translation in the up-down direction and rotation around the first gear 3221 and the second gear 3222. Then, the rotating chain 325 drives the mounting plate 324 to move up and down, thereby driving the drilling rig 31 to move up and down. The arrangement of the chain 325 has a function of multiplying the displacement of the cylinder body of the lifting driver 322 and increasing a movement stroke of the drilling rig 31.

Optionally, as shown in FIG. 11, the frame body 321 is provided with a chain connecting portion 3211 arranged in the middle of the frame body 321, and the rear side of the chain 325 can be detachably connected to the chain connecting portion 3211. The chain connecting portion 3211 is provided with a matching groove, in which the cylinder body of the lifting driver 322 can be embedded, thereby enhancing a guiding effect of the lifting driver 322.

As shown in FIG. 11, the top end of the frame body 321 is provided with an end plate; the end plate is detachably arranged on the frame body 321; the lifting driver 322 and two guide columns 323 are detachably connected to the end plate, which can facilitate the assembly and maintenance of the lifting assembly 32.

In some embodiments, the drilling device 3 can install anchor rods, and the drilling device 3 includes a first drilling device 301 and a second drilling device 302. The first drilling device 301 and the second drilling device 302 are arranged at a tail end of the rack 1 and spaced apart along the width direction of the rack 1. The first drilling device 301 is configured to drill and install anchor rods to a first lateral wall of the tunnel, and the second drilling device 302 is configured to drill and install anchor rods to a second lateral wall of the tunnel.

Figure 4:
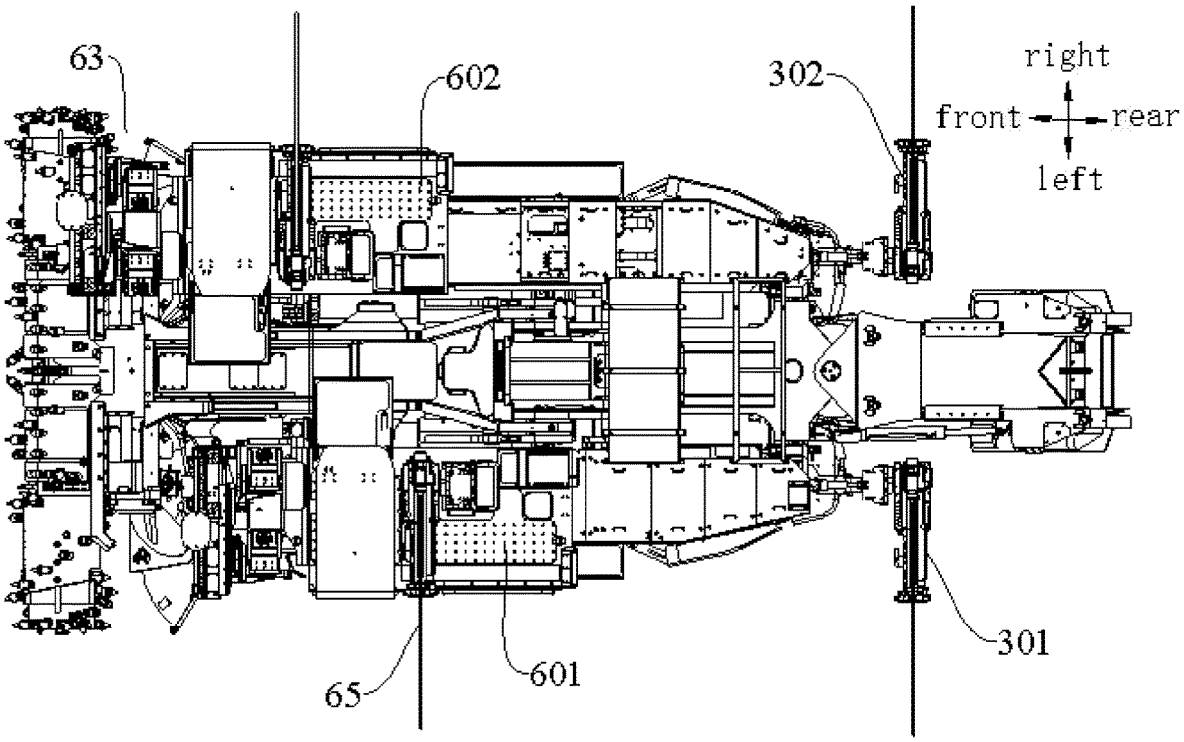
FIG. 4 is a top view of the bolter miner according to embodiments of the present disclosure.
Figure 5:
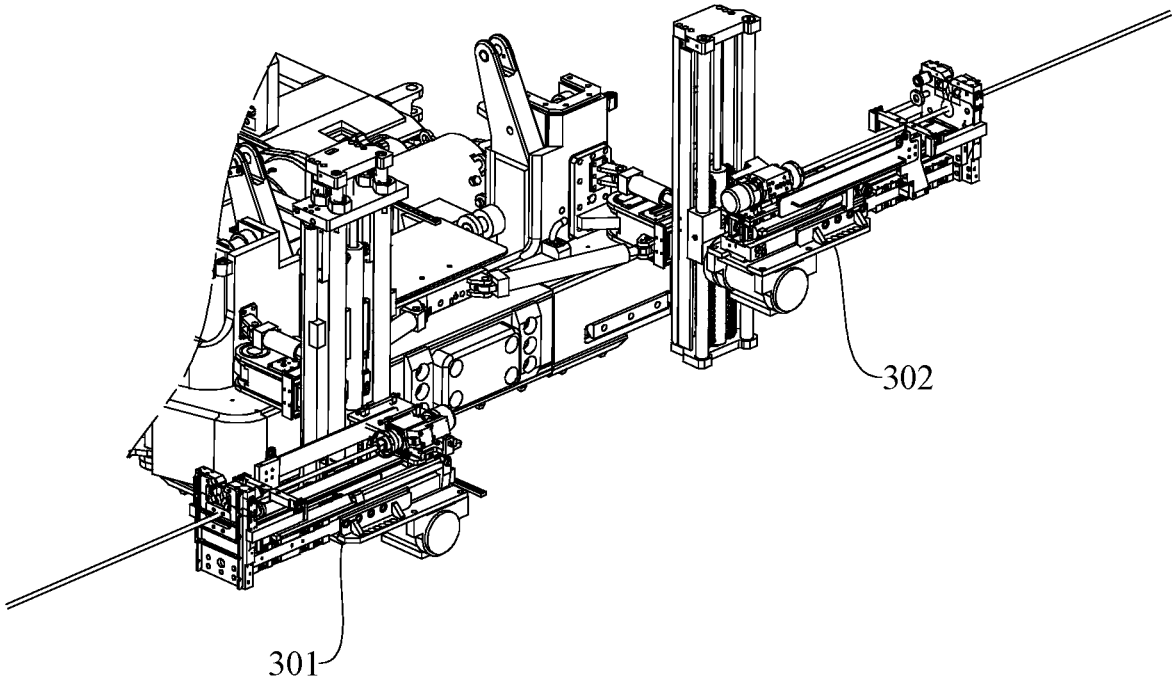
FIG. 5 is a schematic view of a rear structure of a drilling device in FIG. 1.

Specifically, as shown in FIGS. 4 to 6, both the first drilling device 301 and the second drilling device 302 are arranged at a rear side of the rack 1, the first drilling device 301 being at a left side of the rack 1, and the second drilling device 302 being at a right side of the rack 1, and the first drilling device 301 and the second drilling device 302 are generally arranged in a mirror symmetry. The drilling rig 31 of the first drilling device 301 can swing to the left and is mainly used for bolt support for the lateral wall on the left side of the tunnel, and the drilling rig 31 of the second drilling device 302 can swing to the right side and is mainly used for bolt support for the lateral wall on the right side of the tunnel.

On the one hand, the arrangement of the first drilling device 301 and the second drilling device 302 can increase the bolt support efficiency and avoid a situation that a drilling device 3 needs to move back and forth in the left-right direction. On the other hand, the two drilling devices 3 can drill at the same time, which is beneficial to reducing errors and improving the accuracy of monitoring.

In some embodiments, the bolter miner 100 includes a shovel plate device 4 and a conveying trough device 5. The shovel plate device 4 is arranged at a head end of the rack 1 and below the cutting device 2. A size of an inlet of the shovel plate device 4 is adjustable. The conveying trough device 5 is arranged on the rack 1 and at a rear side of the shovel plate device 4, and is configured to convey coal rock gathered by the shovel plate device 4. The first drilling device 301 is arranged at a first side of the conveying trough device 5, and the second drilling device 302 is arranged at a second side of the conveying trough device 5.

Specifically, the shovel plate device 4 is arranged at a front end of the rack 1, and the shovel plate device 4 includes a main shovel plate and two auxiliary shovel plates. The main shovel plate is connected to the rack 1, and the two auxiliary shovel plates are rotatably connected to left and right sides of the main shovel plate, respectively. A shovel plate driver is arranged between each of the two auxiliary shovel plates and the main shovel plate. The swing drive of the corresponding auxiliary shovel plate can be realized through the expansion and retraction of the shovel plate driver, so that the size of the inlet of the shovel plate can be adjusted. The conveying trough device 5 is fixed on the rack 1 and extends in the front-rear direction. A front end of the conveying trough device 5 is docked with the shovel plate device 4, and the coal rock gathered by the shovel plate device 4 can be conveyed through the conveying trough device 5.

As shown in FIG. 4, the first drilling device 301 is arranged on a left side of the conveying trough device 5, and the second drilling device 302 is arranged on a right side of the conveying trough device 5, thus avoiding interference between the drilling device 3 and the conveying trough device 5.

In some embodiments, if the lithology of the tunnel roof is consistent with that of the tunnel floor, the first threshold and the second threshold may be the same. Thus, the setting of the first threshold and the second threshold is simplified.

In some embodiments, the bolter miner 100 includes a bolt support device 6 that includes a lifting component 61, a work platform 62 and a first drilling frame assembly 63. The lifting component 61 is arranged between the rack 1 and the work platform 62 and is configured to raise and lower the work platform 62. The first drilling frame assembly 63 is arranged on the work platform 62. The work platform 62 is telescopic so that the first drilling frame assembly 63 can move to above the cutting device 2. The first drilling frame assembly 63 is configured for bolt support for the roof above the cutting device 2 to reduce an unsupported roof distance.

Figure 12:
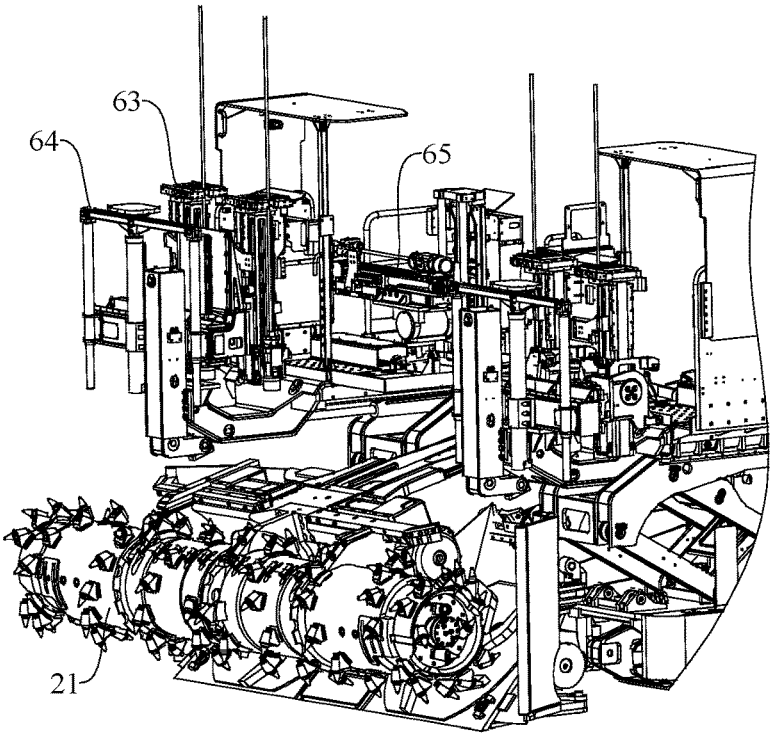
FIG. 12 is an assembly diagram of a bolt support device in FIG. 2.
Figure 13:
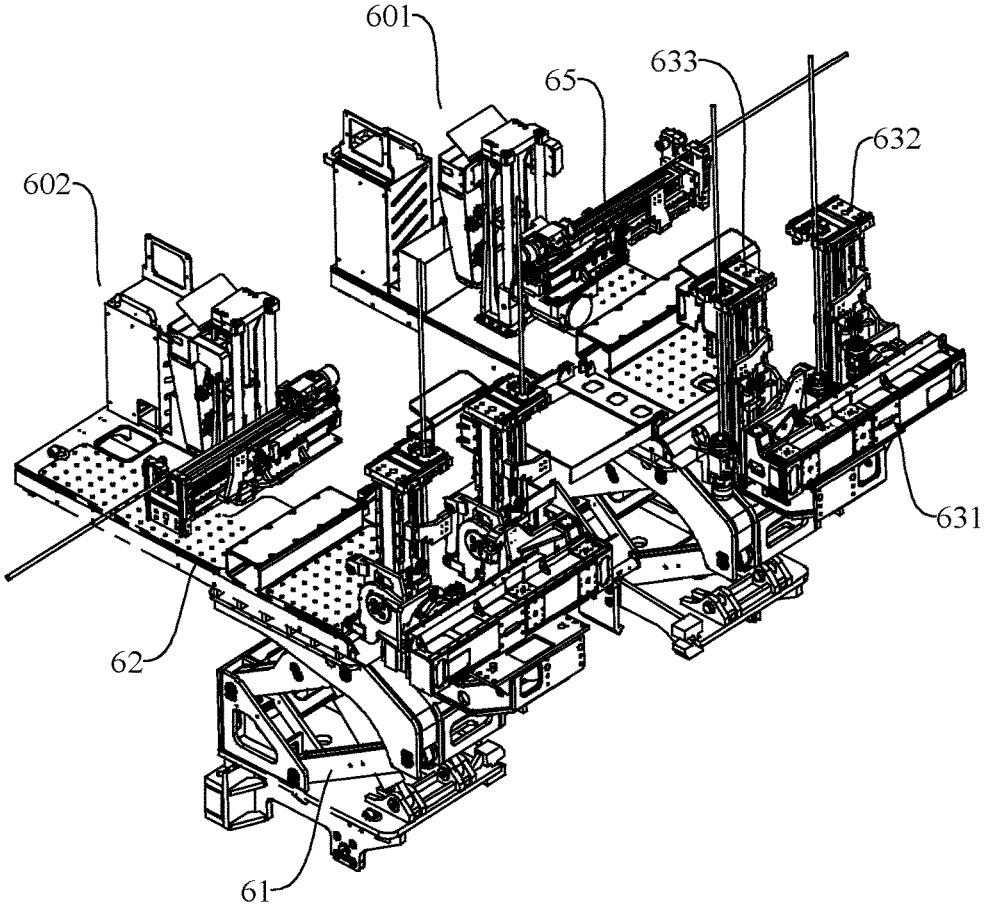
FIG. 13 is a schematic view of the bolt support device in FIG. 2.
Figure 14:
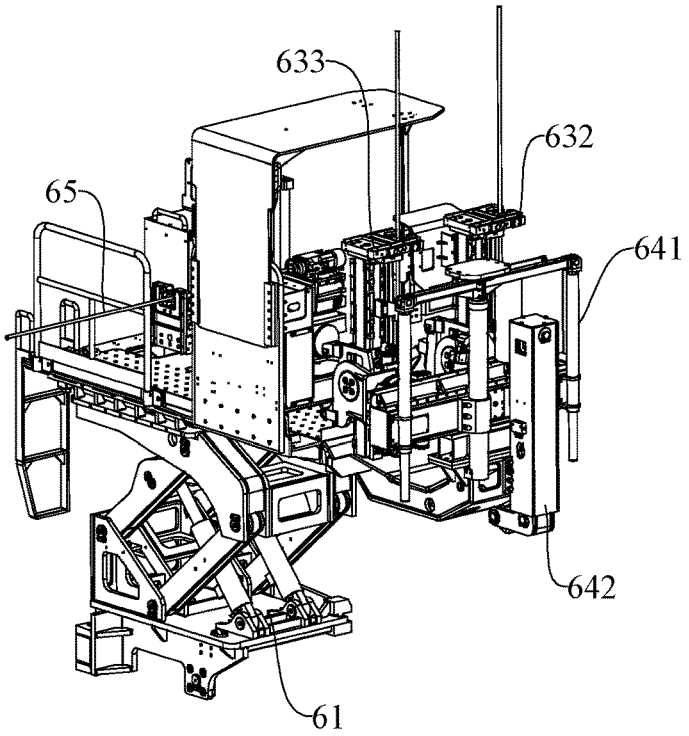
FIG. 14 is a perspective view of a single bolt support device in FIG. 13.

Specifically, as shown in FIG. 12 to FIG. 14, the lifting component 61 is mounted on the rack 1, and the lifting component 61 includes a lifting platform and a lifting oil cylinder. The lifting platform is fixed at the top of the lifting oil cylinder, and the lifting platform can be driven to rise and fall by the lifting oil cylinder. The work platform 62 is fixed on the lifting platform, and the rise and fall of the work platform 62 can be realized through the lifting component 61.

It should be noted that the work platform 62 is a rectangular platform, which extends in the front-rear direction and is telescopic in the front-rear direction. The first drilling frame assembly 63 is mounted at a front end of the work platform 62, and the first drilling frame assembly 63 is used for bolt support operations. Specifically, when the work platform 62 extends forward, the first drilling frame assembly 63 is generally above the cutting drum 21 of the cutting device 2, and the first drilling frame assembly 63 can perform bolt support operations on the tunnel roof near the heading face.

When cutting operations are required, the work platform 62 can be retracted, and the first drilling frame assembly 63 is retreated to behind the cutting drum 21 of the cutting device 2, so that the cutting device 2 can drive the cutting drum 21 to move up and down through the cutting arm, thus realizing the cutting operations and avoiding interference with the cutting device 2.

Consequently, the bolter miner 100 can realize parallel and non-parallel operations of tunneling and bolt support, and also can provide bolt support for the tunnel roof near the head, avoiding the existence of the unsupported roof distance at the heading face, and ensuring safe tunneling under poor conditions of the tunnel roof.

Optionally, as shown in FIG. 13, there may be two bolt support devices 6, i.e., a first bolt support device 601 and a second bolt support device 602. The first bolt support device 601 is arranged on the left side of the rack 1, and the second bolt support device 602 is arranged on the right side of the rack 1.

In some embodiments, the bolt support device 6 includes a stabilization assembly 64. The stabilization assembly 64 includes a first support assembly 641 and a second support assembly 642, which are arranged on the work platform 62. The first support assembly 641 can extend upward and is configured to support the tunnel roof, and the second support assembly 642 can extend downward and is configured to support the cutting device 2.

Specifically, as shown in FIGS. 12 to 14, the stabilization assembly 64 is mounted at the front end of the work platform 62 and located at a front side of the first drilling frame assembly 63. The stabilization assembly 64 is a telescopic oil cylinder. When the first drilling frame assembly 63 switches to a bolt support position, the stabilization assembly 64 can extend and be pressed against and in contact with a top side of the cutting device 2, thereby temporarily supporting the front end of the work platform 62, and avoiding a situation that the work platform 62 overhanging forward for a long time. On the one hand, a problem that the work platform 62 tends to be bent and deformed can be avoided; on the other hand, vibration of the first drilling frame assembly 63 during bolt support operations can be reduced, realizing a structural stabilization function.

It should be noted that in other embodiments, the stabilization assembly 64 may also be pressed against and in contact with the tunnel roof, or the stabilization assembly 64 may also be pressed against and in contact with the tunnel roof and the cutting device 2 at the same time. In other embodiments, the stabilization assembly 64 may also be pressed against and in contact with a lateral wall of the tunnel, thereby performing the bolt support operations on the lateral wall of the tunnel.

As shown in FIG. 14, the stabilization assembly 64 includes a first support assembly 641 and a second support assembly 642. The first support assembly 641 and the second support assembly 642 are arranged on the work platform 62. The first support assembly 641 can extend upwards and is adapted to support the tunnel roof. The second support assembly 642 can extend downwards and is adapted to support the cutting device 2. Both the first support assembly 641 and the second support assembly 642 can be detachably mounted on the front end of the work platform 62 through fasteners such as bolts. Both the first support assembly 641 and the second support assembly 642 may be hydraulic telescopic cylinders, in which the first support assembly 641 can extend upwards and support the tunnel roof, and the second support assembly 642 can extend downwards and support the cutting device 2. On the one hand, the arrangement of the first support assembly 641 and the second support assembly 642 enhances the structural stability during the bolt support operation; on the other hand, the first support assembly 641 and the second support assembly 642 can operate independently, improving the support reliability.

In some embodiments, the bolt support device 6 includes a second drilling frame assembly 65 arranged on the work platform 62, and the drilling device 3 can install anchor rods. The second drilling frame assembly 65 is arranged between the first drilling frame assembly 63 and the drilling device 3 and is suitable to cooperate with the drilling device 3 to provide bolt support for the tunnel lateral wall.

As shown in FIG. 4 and FIG. 13, the work platform 62 includes a first platform and a second platform. The second platform is fixed at a top end of the lifting component 61. The first platform and the second platform are assembled in a guided and sliding manner and can extend forwards. The first drilling frame assembly 63 is fixed at a front end of the first platform, and the second drilling frame assembly 65 is fixed on the second platform. The first drilling frame assembly 63, the second drilling frame assembly 65 and the drilling device 3 can be sequentially arranged from front to rear and spaced apart from one another.

As shown in FIG. 13 and FIG. 14, the first drilling frame assembly 63 includes a first anchor drill 632, a second anchor drill 633 and a mounting seat 631. The mounting seat 631 is fixed at the front end of the first platform. The first anchor drill 632 and the second anchor drill 633 are mounted on the mounting seat 631. The first anchor drill 632 and the second anchor drill 633 can rotate, to realize bolt support for the lateral wall and the roof.

The second drilling frame assembly 65 includes a third anchor drill that can rotate and provide bolt support for the tunnel lateral wall.

In some embodiments, the bolter miner 100 includes a propping device (not shown), which includes a first propping device and a second propping device. The first propping device is arranged on one side of the rack 1, and the first propping device can be propped between a first lateral wall of the tunnel and the rack 1. The second propping device is arranged on the other side of the rack 1, and the second propping device can be propped between a second lateral wall of the tunnel and the rack 1.

Specifically, the propping device is a propping oil cylinder, which can extend along the width direction of the rack 1 and prop the lateral wall of the tunnel. Two propping devices can be provided, i.e., the first propping device and the second propping device. The first propping device is arranged on the left side of the rack 1, extends to the left side and props a left lateral wall of the tunnel. The second propping device is arranged on the right side of the rack 1, extends to the right and props a right lateral wall of the tunnel. Hence, when in use, the bolter miner 100 can be propped and fixed between two lateral walls of the tunnel through the propping device, thus ensuring the stability of the bolter miner 100 during operation.

In some embodiments, a drilling operation on the tunnel floor can include the following steps:

- S1: the number of cycles of tunneling footage advanced by the cutting device 2 is determined according to a thickness of a coal seam. For example, when the coal seam is thick, the bolter miner 100 can advance more cycles of tunneling footage before the drilling operation, that is, the bolter miner can advance a greater distance between two adjacent drilling operations.
- S2: a drilling position on the tunnel floor is determined after the cutting device 2 advances a determined number of cycles of tunneling footage. For example, any area on the tunnel floor can be selected, which will be a subsequent drilling position. Optionally, in order to reduce errors, a plurality of drilling positions can be selected on the tunnel floor, and drilling can be carried out on all the drilling positions.
- S3: the rack 1 is driven to move, and the drilling device is moved to a position corresponding to the drilling position on the tunnel floor, and then the tunnel floor is drilled by using the drilling device.
- S4: a monitoring data signal is transmitted to the control device in real time by using the sensor in a process of drilling the tunnel floor by a first thickness through the drilling device.
- S5: the control device analyzes and compares the monitoring data signal with the first threshold in real time, and corrects the lowest swing angle of the cutting device 2 inside the control device if the monitoring data signal is greater than the first threshold. Specifically, in the process of drilling the tunnel floor by the first thickness, if the monitoring data signal is greater than the first threshold, the drilling operation can be stopped, and then a preset lowest swing angle in the control device can be reduced, so that in the subsequent cutting operation, the cutting arm of the cutting device 2 can reduce a cutting depth of the tunnel floor and correct the cutting direction.

It should be noted that when there are the plurality of drilling positions, monitoring data signals of the plurality of drilling positions can be averaged and then compared with the first threshold.

In some embodiments, a drilling operation on the tunnel roof can include the following steps:

S1: the number of cycles of tunneling footage advanced by the cutting device 2 is determined according to a thickness of a coal seam.

S2: a drilling position on the tunnel roof is determined after the cutting device 2 advances a determined number of cycles of tunneling footage. For example, any area on the tunnel roof can be selected, which will be a subsequent drilling position. Optionally, in order to reduce errors, a plurality of drilling positions can be selected on the tunnel roof, and drilling can be carried out on all the drilling positions.

S3: the rack 1 is driven to move, and the drilling device is moved to a position corresponding to the drilling position on the tunnel roof, and then the tunnel roof is drilled by using the drilling device.

S4: a monitoring data signal is transmitted to the control device in real time by using the sensor in a process of drilling the tunnel roof by a second thickness through the drilling device.

S5: the control device analyzes and compares the monitoring data signal with the second threshold in real time, and corrects the lowest swing angle of the cutting device 2 inside the control device if the monitoring data signal is greater than the second threshold. Specifically, in the process of drilling the tunnel roof by the second thickness, if the monitoring data signal is greater than the second threshold, the drilling operation can be stopped, and then a preset highest swing angle in the control device can be reduced, so that in the subsequent cutting operation, the cutting arm of the cutting device 2 can reduce a cutting depth of the tunnel roof and correct the cutting direction.

A tunneling system according to embodiments of the present disclosure will be described below.

The tunneling system according to embodiments of the present disclosure includes a bolter miner 100 that can be the bolter miner 100 described in the above embodiments. The tunneling system can also include a transfer machine, a self-moving powered tail, a belt conveyor, and etc. The bolter miner 100, the transfer machine, the self-moving powered tail, and the belt conveyor are arranged in sequence in a direction opposite to a tunneling direction. The coal rock cut by the bolter miner 100 can be transported to the ground through the transfer machine, the self-moving powered tail, the belt conveyor and the like.

The bolter miner according to embodiments of the present disclosure prevents the cutting device from cutting the roof rock stratum and the floor rock stratum, improves the recovery rate, and prolongs the equipment service life.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, the term "a plurality of" means at least two, such as two or three, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communication or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Furthermore, the particular features, structures, materials, or characteristics may be combined in any suitable manner in one or more embodiments or examples. Moreover, those skilled in the art can integrate and combine the different embodiments or examples and the features of the different embodiments or examples described in this specification without contradicting each other.

Although embodiments of the present disclosure have been shown and described, it can be appreciated by those skilled in the art that the above embodiments are merely exemplary and are not intended to limit the present disclosure, and various changes, modifications, alternatives and variations may be made in the embodiments within the scope of the present disclosure.

What is claimed is:

1. A bolter miner, comprising:

a rack;

a cutting device arranged on the rack and being swingable in an up-down direction, wherein the cutting device comprises a lowest swing angle, at which the cutting device is configured to cut coal rock at a bottom of a working face in a rock formation, and comprises a highest swing angle, at which the cutting device is configured to cut coal rock at a top of the working face;

a drilling device arranged on the rack and comprising a drilling rig and a sensor electrically connected to the drilling rig, wherein the drilling rig is configured to drill at least one of a tunnel floor or a tunnel roof, and the sensor is configured to monitor set parameters of the drilling rig and to generate a monitoring data signal when the drilling rig is drilling, wherein the set parameters are related to properties of the rock formation; and a control device, to which the sensor is electrically connected, wherein the control device is configured to receive and analyze the monitoring data signal; when the drilling rig is drilling the tunnel floor by a first thickness, the control device is configured to reduce the lowest swing angle in response to the monitoring data signal being greater than a first threshold; and when the drilling rig is drilling the tunnel roof by a second thickness, the control device is configured to reduce the highest swing angle in response to the monitoring data signal being greater than a second threshold, wherein the first threshold is a numerical parameter corresponding to a propulsion force of the drilling rig when breaking through an interface between a coal seam and a rock stratum below the coal seam, and the second threshold is a numerical parameter corresponding to a propulsion force of the drilling rig when breaking through an interface between the coal seam and a rock stratum above the coal seam.

2. The bolter miner according to claim 1, wherein the drilling device comprises a lifting assembly connected to the rack; the drilling rig is arranged on the lifting assembly and is configured to install anchor rods; the lifting assembly is configured to lift the drilling rig, to allow the drilling rig to drill the tunnel floor and the tunnel roof.

3. The bolter miner according to claim 2, wherein the drilling device comprises a connecting member and a swinging driver; the connecting member has a first end connected to the lifting assembly and a second end rotatably connected to the rack; the swinging driver has a first end rotatably connected to the rack and a second end rotatably connected to the connecting member; the swinging driver is configured to drive the connecting member to swing in a width direction of the rack to adjust a distance between the drilling rig and a tunnel lateral wall.

4. The bolter miner according to claim 3, wherein the drilling device comprises a displacement driver, an extension direction of the displacement driver being identical to an extension direction of the connecting member; the displacement driver has a first end rotatably connected to the rack and a second end rotatably connected to the lifting assembly; the connecting member and the displacement driver are configured to expand and retract synchronously; the displacement driver is configured to drive the drilling rig to move in a length direction of the rack to adjust row spacing of anchor rods.

5. The bolter miner according to claim 3, wherein the connecting member comprises an inner sleeve and an outer sleeve; the inner sleeve is fitted in the outer sleeve and is slidable relative to the outer sleeve; a free end of the outer sleeve is rotatably connected to the rack, and a free end of the inner sleeve is rotatably connected to the lifting assembly; the swinging driver is rotatably connected to the outer sleeve; the outer sleeve is provided with an oil injection mouth configured to inject lubricating oil into the outer sleeve.

6. The bolter miner according to claim 2, wherein the drilling rig is rotatably connected to the lifting assembly, and the drilling rig is swingable in a height direction of the rack and the length direction of the rack to adjust an anchor rod installation direction.

7. The bolter miner according to claim 2, wherein:

the lifting assembly comprises a frame body, a lifting driver, a guide column, a mounting plate and a chain;

the guide column is arranged on the frame body and extends in the up-down direction;

the mounting plate is mounted on the guide column in a guided and sliding manner and is configured to mount the drilling rig;

one end of the lifting driver is connected to the frame body, and the lifting driver is provided with a first gear and a second gear, which are spaced apart along an extension direction of the lifting driver;

the chain is engaged around outer circumferences of the first gear and the second gear and is connected to the mounting plate and the frame body, and the chain is configured to translate and rotate to drive the mounting plate to move, when the lifting driver is extended and retracted.

8. The bolter miner according to claim 2, wherein the drilling device install anchor rods and comprises a first drilling device and a second drilling device; the first drilling device and the second drilling device are arranged at a tail end of the rack and spaced apart along the width direction of the rack; the first drilling device is configured to drill and install anchor rods to a first lateral wall of the tunnel; and the second drilling device is configured to drill and install anchor rods to a second lateral wall of the tunnel.

9. The bolter miner according to claim 8, further comprising a shovel plate device and a conveying trough device, wherein the shovel plate device is arranged at a head end of the rack and below the cutting device; a size of an inlet of the shovel plate device is adjustable; the conveying trough device is arranged on the rack and at a rear side of the shovel plate device and is configured to convey coal rock gathered by the shovel plate device; the first drilling device is arranged at a first side of the conveying trough device, and the second drilling device is arranged at a second side of the conveying trough device.

10. The bolter miner according to claim 1, further comprising a shovel plate device and a conveying trough device, wherein the shovel plate device is arranged at a head end of the rack and below the cutting device; a size of an inlet of the shovel plate device is adjustable; and the conveying trough device is arranged on the rack and at a rear side of the shovel plate device and is configured to convey coal rock gathered by the shovel plate device.

11. The bolter miner according to claim 1, wherein the first threshold is identical to the second threshold when lithology of the tunnel roof is consistent with lithology of the tunnel floor.

12. The bolter miner according to claim 1, further comprising a bolt support device that comprises a lifting assembly, a work platform and a first drilling frame assembly, wherein the lifting assembly is arranged between the rack and the work platform and is configured to raise and lower the work platform; the first drilling frame assembly is arranged on the work platform; the work platform is telescopic to allow the first drilling frame assembly to move to above the cutting device; the first drilling frame assembly is configured for bolt support for the roof above the cutting device to reduce an unsupported roof distance.

13. The bolter miner according to claim 12, wherein the bolt support device comprises a stabilization assembly that comprises a first support assembly and a second support assembly; the first support assembly and the second support assembly are arranged on the work platform; the first support assembly extends upward and is configured to support the tunnel roof; and the second support assembly extends downward and is configured to support the cutting device.

14. The bolter miner according to claim 13, wherein the bolt support device comprises a second drilling frame assembly arranged on the work platform; the drilling device installs anchor rods; the second drilling frame assembly is arranged between the first drilling frame assembly and the drilling device and cooperates with the drilling device to provide bolt support for a tunnel lateral wall.

15. An operation method for a bolter miner, wherein the bolter miner performs a drilling operation on a tunnel floor in a rock formation by:

determining the number of cycles of tunneling footage advanced by a cutting device according to a thickness of a coal seam;

determining a drilling position on the tunnel floor after the cutting device advances a determined number of cycles of tunneling footage;

driving a rack to move, the cutting device arranged on the rack and being swingable in an up-down direction, moving a drilling device to a position corresponding to the drilling position on the tunnel floor, and drilling the tunnel floor by the drilling device, the drilling device arranged on the rack and comprising a drilling rig and a sensor electrically connected to the drilling rig;

transmitting a monitoring data signal to a control device in real time by using the sensor in a process of drilling the tunnel floor by a first thickness through the drilling device, wherein the sensor is configured to monitor set parameters of the drilling rig and to generate the monitoring data signal when the drilling rig is drilling, wherein the set parameters are related to properties of the rock formation; and analyzing and comparing, by the control device, the monitoring data signal with a first threshold in real time, and correcting a lowest swing angle of the cutting device inside the control device in response to the monitoring data signal being greater than the first threshold, the first threshold is a numerical parameter corresponding to a propulsion force of the drilling rig when breaking through an interface between a coal seam and a rock stratum below the coal seam in the rock formation.

16. The operation method for the bolter miner according to claim 15, wherein the bolter miner performs a drilling operation on the tunnel roof by:

determining the number of cycles of tunneling footage advanced by the cutting device according to a thickness of the coal seam;

determining a drilling position on the tunnel roof after the cutting device advances a determined number of cycles of tunneling footage;

driving the rack to move, moving the drilling device to a position corresponding to the drilling position on the tunnel roof, and drilling the tunnel roof by the drilling device;

transmitting a monitoring data signal to the control device in real time by using the sensor in a process of drilling the tunnel roof by a second thickness through the drilling device; and analyzing and comparing, by the control device, the monitoring data signal with a second threshold in real time, and correcting a highest swing angle of the cutting device inside the control device in response to the monitoring data signal being greater than the second threshold, and the second threshold is a numerical parameter corresponding to a propulsion force of the drilling rig when breaking through an interface between the coal seam and a rock stratum above the coal seam.

17. A tunneling system, comprising a bolter miner, wherein the bolter miner comprises:

a rack;

a cutting device arranged on the rack and being swingable in an up-down direction, wherein the cutting device comprises a lowest swing angle, at which the cutting device is configured to cut coal rock at a bottom of a working face in a rock formation, and comprises a highest swing angle, at which the cutting device is configured to cut coal rock at a top of the working face;

a drilling device arranged on the rack and comprising a drilling rig and a sensor electrically connected to the drilling rig, wherein the drilling rig is configured to drill at least one of a tunnel floor or a tunnel roof, and the sensor is configured to monitor set parameters of the drilling rig and to generate a monitoring data signal when the drilling rig is drilling, wherein the set parameters are related to properties of the rock formation; and a control device, to which the sensor is electrically connected, wherein the control device is configured to receive and analyze the monitoring data signal; when the drilling rig is drilling the tunnel floor by a first thickness, the control device is configured to reduce the lowest swing angle in response to the monitoring data signal being greater than a first threshold; and when the drilling rig is drilling the tunnel roof by a second thickness, the control device is configured to reduce the highest swing angle in response to the monitoring data signal being greater than a second threshold, wherein the first threshold is a numerical parameter corresponding to a propulsion force of the drilling rig when breaking through an interface between a coal seam and a rock stratum below the coal seam of the rock formation, and the second threshold is a numerical parameter corresponding to a propulsion force of the drilling rig when breaking through an interface between the coal seam and a rock stratum above the coal seam.

18. The tunneling system according to claim 17, wherein the drilling device comprises a lifting assembly connected to the rack; the drilling rig is arranged on the lifting assembly and is configured to install anchor rods; the lifting assembly is configured to lift the drilling rig, to allow the drilling rig to drill the tunnel floor and the tunnel roof.

19. The tunneling system according to claim 18, wherein the drilling device comprises a connecting member and a swinging driver; the connecting member has a first end connected to the lifting assembly and a second end rotatably connected to the rack; the swinging driver has a first end rotatably connected to the rack and a second end rotatably connected to the connecting member; the swinging driver is configured to drive the connecting member to swing in a width direction of the rack to adjust a distance between the drilling rig and a tunnel lateral wall.

* * * * *